United States Patent [19]

Ramhorst

[11] Patent Number: 4,776,582

[45] Date of Patent: Oct. 11, 1988

[54] EXERCISE TREADMILL WITH ADJUSTABLE SLOPE

[75] Inventor: Jo D. Ramhorst, Bainbridge Island, Wash.

[73] Assignee: M & R Industries, Inc., Redmond, Wash.

[21] Appl. No.: 917,170

[22] Filed: Oct. 9, 1986

[51] Int. Cl.[4] ..... A63B 23/06

[52] U.S. Cl. ..... 272/69; 272/DIG. 4

[58] Field of Search ..... 272/62, 63, 69, 102, 272/103, DIG. 4; 5/11, 63, 64, 509, 510; 254/114, 116, 118, 119, 120, 123, 129, 130

[56] References Cited

U.S. PATENT DOCUMENTS 4,344,616 8/1982 Ogden ..... 272/69

FOREIGN PATENT DOCUMENTS 1432392 5/1965 France ..... 272/69
3114658 10/1982 Fed. Rep. of Germany ..... 5/509
860022 5/1964 United Kingdom ..... 5/510
1545016 5/1979 United Kingdom ..... 5/510
2076664 12/1981 United Kingdom ..... 272/69

*Primary Examiner*—Richard J. Apley
*Assistant Examiner*—Franklin L. Gubernick
*Attorney, Agent, or Firm*—Seed and Berry

[57] ABSTRACT

An exercise treadmill in which the slope of an endless belt is varied by changing the height of one end of a base frame by means of a swing frame having a vertically adjustable pivot axis. The swing frame is movable from an active treadmill supporting position to an inactive condition where the pivot axis can be changed.

10 Claims, 3 Drawing Sheets

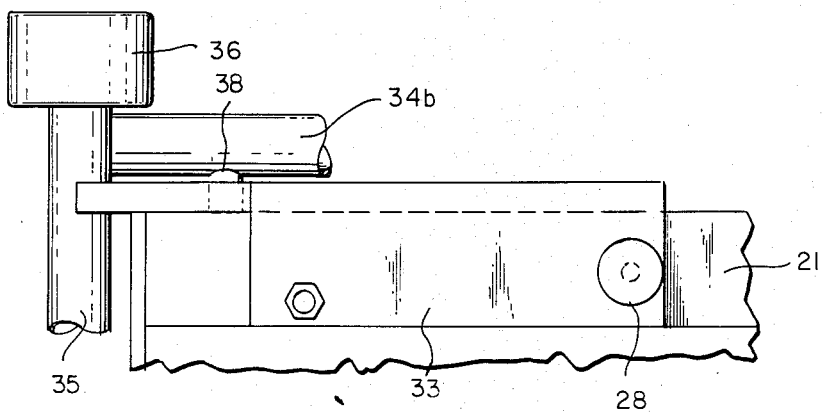
FIG. 3
FIG. 4
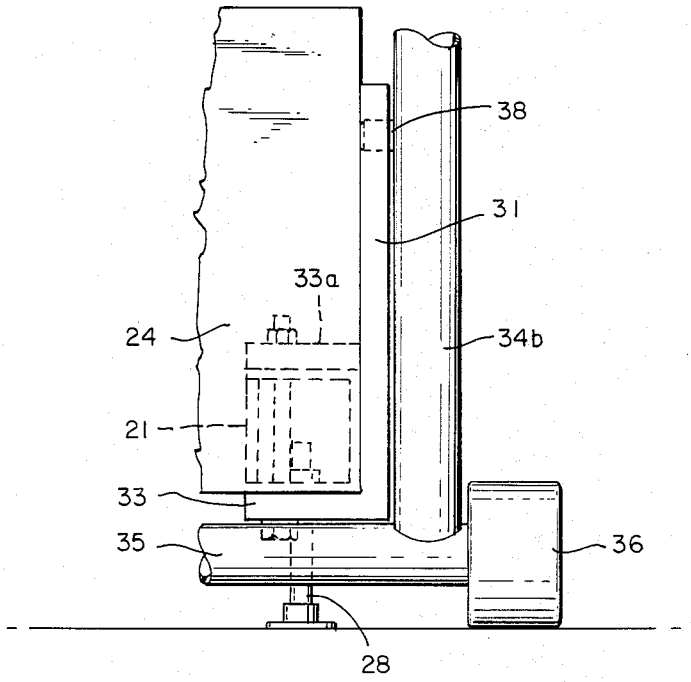

EXERCISE TREADMILL WITH ADJUSTABLE SLOPE

DESCRIPTION

1. Technical Field

The present invention relates to portable exercise treadmills of the type having an endless motor-driven belt with an upper run on which the exerciser walks, jogs or runs, and more particularly relates to such a treadmill in which the endless belt may be given an adjustable slope.

2. Background Art

The support frames of portable exercise treadmills have commonly had short ground engaging legs of adjustable height for leveling the frame, but these have not been intended for use in intentionally sloping the frame to responsively slope the endless belt and thereby simulate an uphill condition. Some treadmills have had slope adjustment by simultaneously vertically extending a pair of legs by various mechanisms operated, for example, by hand crank or power driver.

3. Disclosure of the Invention

The present invention aims to provide an adjusting mechanism whereby the height of the forward end of a treadmill can be easily adjusted without loss of stability to slope the endless belt within a range of several slope settings not involving the extension or retraction of legs.

In carrying out the invention there is provided a front swing frame having a pair of horizontally aligned trunnions which have several height settings by way of groups complementing vertically-spaced fulcrums provided in a pair of side plates mounted on the support frame of the treadmill. These fulcrums consist of downwardly facing gullets formed at the front of a forwardly and downwardly sloped slot or recess in the side plates serving as a transferway between the gullets. The swing frame has wheels at the bottom which roll rearwardly alongside the treadmill frame responsive to pivoting of the swing frame induced by manually pulling forwardly on the swing frame above the level of the side plates until the wheels are rearward of the transferways so that they can be manipulated into another pair of gullets to provide the desired treadmill slope. Then the swing frame is pushed rearwardly at the top thereby causing the wheels to roll forwardly beyond the transferways and causing the top of the swing frame to engage stops located rearwardly of the transferways. The weight of the treadmill then keeps the trunnions engaged within the selected gullets.

BRIEF DESCRIPTION OF THE DRAWINGS

FIG. 3 is a fragmentary bottom view beneath the portion shown in FIG. 2.

FIG. 4 is a fragmentary front view of the portion shown in FIG. 2.

BEST MODE FOR CARRYING OUT THE INVENTION

Figure 1:
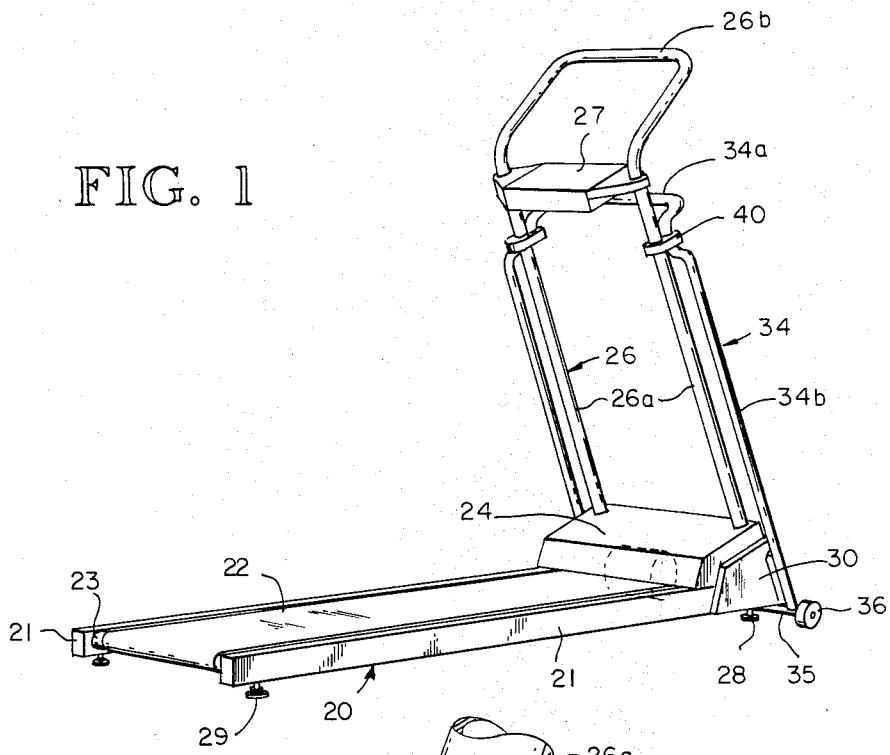
FIG. 1 is a side elevational view of a treadmill embodying the present invention.
Figure 2:
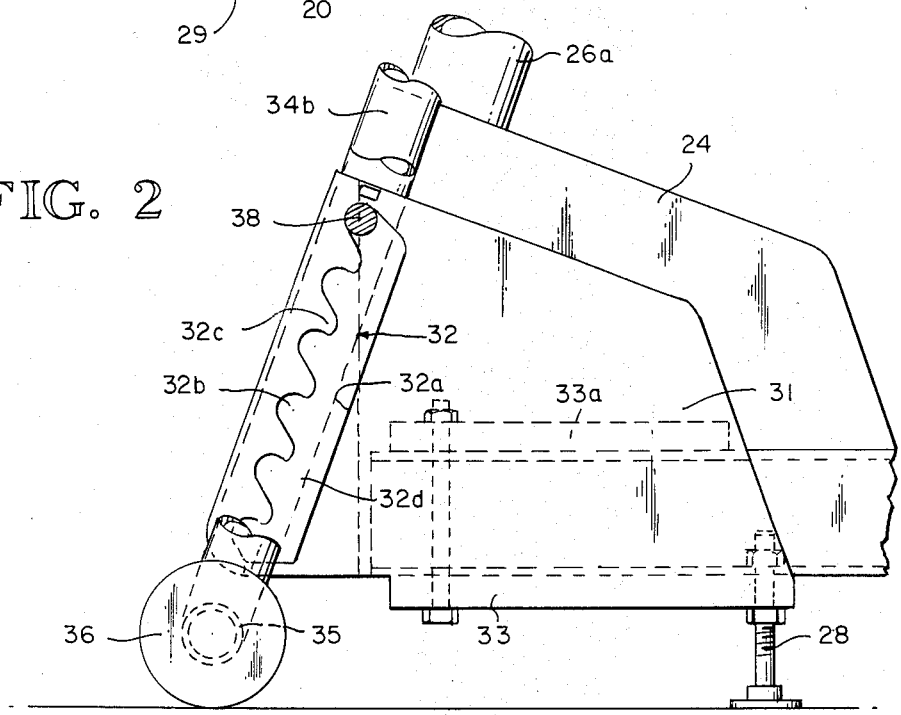
FIG. 2 is a detailed fragmentary side elevational view of a forward portion of the treadmill as viewed from the left side.

Referring to the drawings, the present invention is illustrated applied, for example, to an exercise treadmill having a base frame 20 with longitudinal side rails 21 between which an endless belt 22 is mounted on cross-rollers 23. The belt 22 is driven at the front by a cog-belt drive from a variable speed electric motor covered by a front housing 24. Upstanding rigidly from the side rails 21 is a bar frame unit 26 which includes a pair of sloped legs **26*a* between which is mounted a top cross-bar 26*b* and a control panel 27. This control panel typically has a speed control switch for the motor, an on/off switch, and a timer. Depending from the side rails 21 are front feet 28 and rear adjustable leveling feet 29**.

In accordance with the present invention, a pair of side fulcrum plates 30, 31 are mounted at the ends of the front housing 24 outboard of the legs **26*a* and side rails 21. These side plates are rigidly connected to the base frame 20, as by lateral flanges 33 and 33*a* straddling and bolted to the side rails 21, and may gain lateral support from the bar unit 26. Near the front, the side plates 30, 31 have an outwardly exposed, elongated cutout or recess 32 which has a back ramp edge 32*a* sloping generally like the adjacent legs 26*a* of the bar unit 26, and has a wavy front edge generally sloping in parallel relation to the back edge 32*a*. This wavy front edge has a series of fulcrum gullets 32*b* separated by a series of dowwnardly hooked retaining teeth 32*c* which are spaced forwardly of the back edge 32*a* by a sloped guideway 32*d* closed top and bottom. The gullets 32*b* are rounded at the under side of the teeth 32*c*, and the guideway 32*d* is slightly wider between the teeth 32*c* and the back ramp edge 32*a* than the diameter of the curvature of the upper portions of the gullets 32*b***.

For operation with the fulcrum plates 30, 31, there is provided a front swing frame 34 which comprises an inverted U-shaped tubular member providing an upper crossmember **34*a* and a pair of depending legs 34*b* which are connected to a bottom transverse tubular axle 35. This axle projects laterally at each end to receive a pair of wheels 36. The legs 34*b* have a pair of opposed trunnions 38 which project into the cutouts 32 in the side plates 30, 31 to selectively occupy the gullets 32*b*. The distance from the trunnions 38 to the axle 35 is sufficient compared to the distance from the top gullets 32*b* to the underside of the front end of the base frame 20 to permit the axle 35 to clear the front end of the base frame 20 when the trunnions occupy the top gullets and the lower end of the frame 34 is swung past the forward end of the side rails 21. The swing frame 34 is preferably provided with a pair of U-shaped spring clips 40 positioned to grip the legs 26*a* of the front bar frame 26** when the desired height adjustment has been obtained.

It will be noted that the bar frame legs **26*a* and the side plate cutouts 32 slope forwardly in the down direction. This arrangement positions the gullets 32*b* forwardly of the portions of the frame legs 26*a* which are higher than the side plates 30, 31. Hence, locking engagement of the spring clips 40 with the front bar legs 26*a* can occur only when the axle 34*b* is positioned forwardly of the particular gullets 32*b* occupied by the trunnions 38. In other words, the axis of the wheels 36 will always be "over center", forwardly of the selected swing axis of the swing frame 34**, when the swing frame is in locked position with its wheels in floor engagement supporting the forward part of the treadmill. It will be apparent that the weight of the treadmill and the person exercising will act to keep the swing frame in locked position while the treadmill is in operation.

Figure 5:
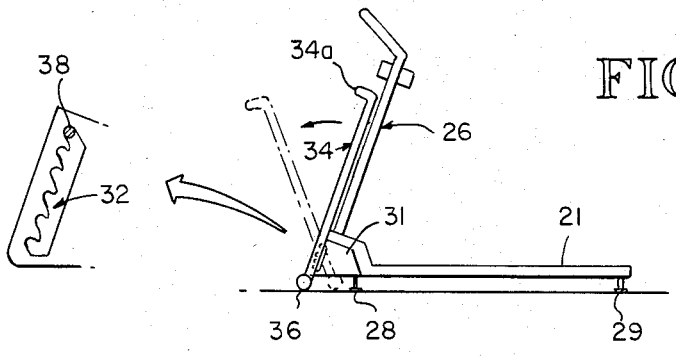
FIGS. 5–7 are schematic views illustrating the procedure for adjusting the treadmill from a level condition (minimum slope) to a maximum slope condition.
Figure 6:
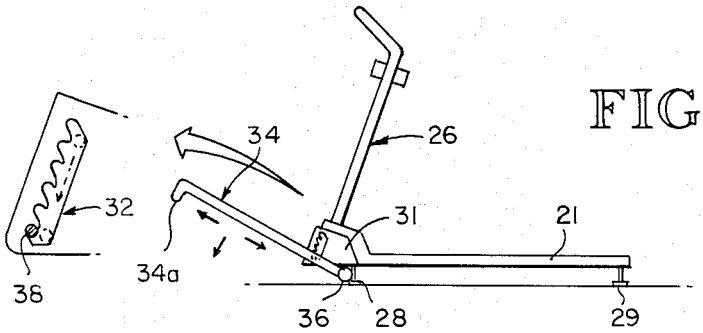
Figure 7:
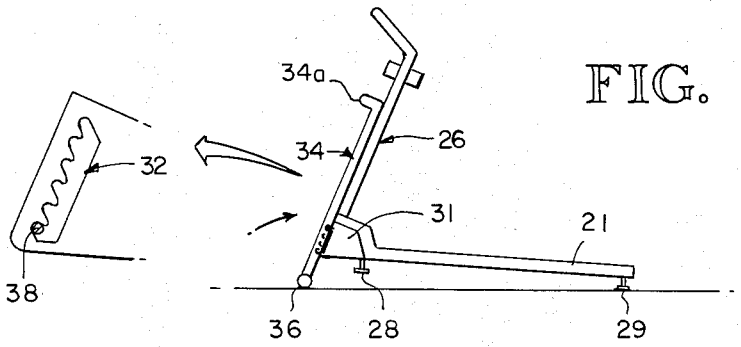

As indicated in FIG. 5, when, for example, it is desired to raise the elevation of the front of the treadmill to thereby change the slope of the belt 22, the exerciser takes a position in front of the machine, grips the cross-bar 34*a*, and pulls forwardly to disengage the spring clips 40 and swing the swing frame 34 about its trunnions 38. This swinging movement causes the wheels 36 to roll rearwardly on the floor. The forward pulling on the cross-bar 34*a* is continued until the axle 35 passes beneath the forward end of the base frame 20 and swings rearwardly sufficiently for the load of the forward part of the treadmill to transfer from the wheels 36 to the forward feet 28. At that point, as indicated in FIG. 6, the swing frame 34 can be easily manipulated to move the trunions 38 up or down in the guideway portion 32d of the recesses 32 in the side plates until the trunnions 38 reach the mouth of the two gullets 32*b* at opposite sides corresponding to the desired slope of the belt 22. The operator then pushes upwardly and rearwardly on the cross-bar 34*a*, thereby causing the wheels to roll forwardly, take the load back from the forward feet 28, and continue to pass "over center" forwardly beyond the base frame 20 until the spring clips engage the bar frame legs 26*a* so that the bar-frame unit 26 then functions as a stop unit with respect to the swing frame 34. FIG. 5 illustrates the position at minimum belt slope (level) and FIG. 7 shows the position of maximum belt slope.

The wheels 36 not only assist in ease of operation of the swing frame 34, but also make it easier to move the treadmill, if desired, since the treadmill can be wheeled about when the rear end is lifted sufficiently to take the weight off the rear feet 29.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. An exercise treadmill comprising:

a frame assembly including an elongated base frame and a stop unit, said base frame having front and back ends and lateral sides, said stop unit reaching upwardly from the base frame adjacent the front end of the frame assembly;

an endless belt operatively mounted on said frame assembly and having an upper run arranged to move rearwardly with respect to the baes frame when operating;

two laterally spaced and aligned fulcrum members mounted on the frame assembly and each presenting a set of vertically spaced fulcrums interconnected by a transferway and located below the reach of the stop unit;

a swing frame having an aligned pair of laterally spaced trunnions interfitting with said fulcrum members to be movable selectively from fulcrum to fulcrum of said sets of fulcrums via the transferways, and having a pair of laterally spaced group engaging wheels spaced below the trunnions such that the front end of the base frame is raised at different elevations when the trunnions register with different of said fulcrums;

said swing frame engaging the stop unit above the level of the fulcrum members when in an active position whereat the wheels engage the ground forwardly of the stop unit and trunnions to establish the elevation of the front end of the frame assembly by the fulcrums selected for the trunnions, said swing frame being swingable forwardly at the top to an inactive position whereat the wheels engage the ground behind the transferway so that the trunnions can be moved rearwardly into the transferway and shifted in elevation into another selected fulcrum whereupon the swing frame can be swung rearwardly at the top into active position in engagement with the stop unit.

2. An exercise treadmill according to claim 1 in which said stop unit has a laterally spaced pair of upright members engaged by said swing frame when the swing frame is in its active position.

3. An exercise treadmill according to claim 2 in which said swing frame has spring clips interfitting with said upright members.

4. An exercise treadmill according to claim 1 in which said stop unit has a laterally spaced pair of upright members connected by a top member, and said swing frame includes a pair of legs on which said trunnions are mounted and includes an upper cross-member extending between said legs and arranged to engage said upright members when the swing frame is in its active position.

5. An exercise treadmill according to claim 4 in which said pair of legs slope forwardly from said upper cross-member toward their lower ends when said swing frame is in its active position.

6. An exercise treadmill according to claim 4 in which said transferways slope forwardly from their upper ends toward their lower ends, and said swing frame slopes forwardly from said upper cross-member toward said wheels when the swing frame is in its said active position.

7. An exercise treadmill according to claim 4 in which said swing frame has an axle for said wheels extending between said legs adjacent the lower end thereof, said axle being arranged to pass beneath the forward end portion of said base frame while the swing frame is swinging between its active and inactive positions.

8. An exercise treadmill according to claim 1 in which said base frame has a normally inactive front ground support spaced behind the rotary axis of said wheels when said swing frame is in its inactive position, said front ground support being arranged to engage the ground when the swing frame is in its inactive position and to be raised above the ground when the swing frame is in its active position.

9. An exercise treadmill according to claim 8 in which said swing frame has an axle for said wheels which is arranged to pass beneath the forward end of said base frame while the swing frame is moving between its active and inactive positions.

10. An exercise treadmill according to claim 1 in which said swing frame slopes downwardly in the forward direction from said trunnions to the rotary axis of said wheels when the swing frame is in its active position and slopes downwardly in the rearward direction from said trunnions to said rotary axis when the swing frame is in its inactive position.

* * * * *